US005080216A

United States Patent [19]

Abe

[11] Patent Number: 5,080,216

[45] Date of Patent: Jan. 14, 1992

[54] ELECTRONIC COIN DISCRIMINATING APPARATUS

[75] Inventor: Hiroshi Abe, Tokyo, Japan

[73] Assignee: Asahi Seiko Kabushiki Kaisha, Tokyo, Japan

[21] Appl. No.: 487,610

[22] Filed: Mar. 2, 1990

[30] Foreign Application Priority Data

Mar. 9, 1989 [JP] Japan ..... 1-54947

[51] Int. Cl.[5] ..... G07D 5/02; G07D 5/08

[52] U.S. Cl. ..... 194/317; 194/334

[58] Field of Search ..... 194/307, 308, 315, 317, 194/318, 334, 210; 453/3

[56] References Cited

U.S. PATENT DOCUMENTS 1,910,963 5/1933 Polsen et al. ..... 194/308

3,211,267 10/1965 Bayha ..... 194/317 X 3,977,508 8/1976 Baumberger ..... 194/334 X 4,041,280 8/1977 Ohsako et al. ..... 453/32 X

*Primary Examiner*—F. J. Bartuska

*Attorney, Agent, or Firm*—Nilles & Nilles

[57] ABSTRACT

An apparatus for electronically discriminating coin diameter includes a vertical or inclined coin passage defined by a pair of opposed side plates and a pair of opposed edge plates. A pair of proximity switches are opposedly arranged at the opposed edge plate sides and spaced from each other by a distance corresponding to the diameter of a genuine coin to be discriminating, and an electronic circuit is arranged such that when both of the proximity switches are simultanuously turned ON by a coin passing through the coin passage, a genuine coin diameter signal is output.

8 Claims, 2 Drawing Sheets

ELECTRONIC COIN DISCRIMINATING APPARATUS

BACKGROUND OF THE INVENTION

1. Field of the Invention

The present invention relates to a coin discriminating apparatus, in particular to an apparatus for electronically discriminating diameter of coins.

2. Related Art Statement

Hitherto, coin discriminating apparatus, have been known using a plurality of sensor coils arranged along a coin passage for discriminating material, thickness and diameter of coin by detecting a variation of an inductance which is generated in each of the sensor coils by a coin passing through the coin passage when a magnetic field generated by the sensor coil is crossed by the coin.

In such a coin discriminating apparatus, it is known to individually discriminate diameter and material of coin to obtain a high accuracy of discrimination. Thus, there have been known various means for electronically, mechanically or optically discriminating diameter of coin.

In case of electronically discriminating diameter of coin by means of sensor coil, it is required to use a sensor coil having a large diameter and an L. C. oscillating circuit connected to the sensor coil to detect the coin diameter by way of detecting a variation of oscillation frequency or oscillating voltage and consequently is expensive. In case of mechanically discriminating, there are disadvantages that a construction of the coin passage is intricated and the apparatus becomes large as the whole. In case of optically discriminating, there are disadvantages that counterfeit coins having a diameter increased by taping can not be detected and the arrangement of optical sensor is difficult.

SUMMARY OF THE INVENTION

It is an object of the present invention is to resolve the aforementioned problems and to provide a simple and economical apparatus for electronically discriminating the coin diameter.

According to the present invention, electronic coin discriminating apparatus comprises a pair of proximity switches such as magnetic type proximity switches which are opposedly arranged at the opposite sides of a coin passage and spaced from each other by a distance corresponding to the diameter of the genuine coin to be discriminating, and means for outputting a genuine coin diameter signal when both the proximity switches are simultaneously turned ON by a coin passing through the coin passage.

With the above arrangement of a pair of proximity switches, only when a genine coin having the predetermined diameter passes through the coin passage between both the proximity switches, both the proximity switches are simultaneously turned ON, but when non-acceptable coins having smaller diameter than that of the genuine coin or counterfeit coins having the same diameter increased by taping as that of the genuine coin pass through the coin passage between both the proximity switches, only one of the proximity switches is turned ON or both the proximity switches are not turned ON so that the genuine coin diameter signal is not output.

It will be seen from the above that according to the present invention, a circuit for detecting coin diameter can be arranged in very simple manner and unexpensively.

The invention will now be better understood from the following description with reference to the accompanying drawing.

DESCRIPTION OF THE PREFERRED EMBODIMENT

Figure 1:
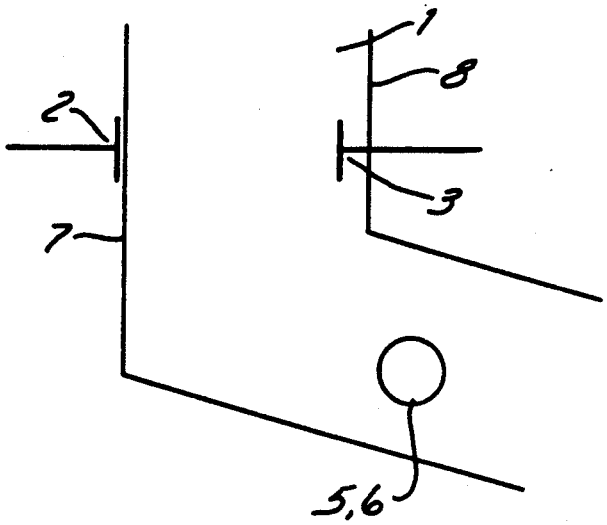
FIG. 1 is a schematic view illustrating an embodiment of the electronic coin discriminating apparatus according to the present invention.
Figure 2:
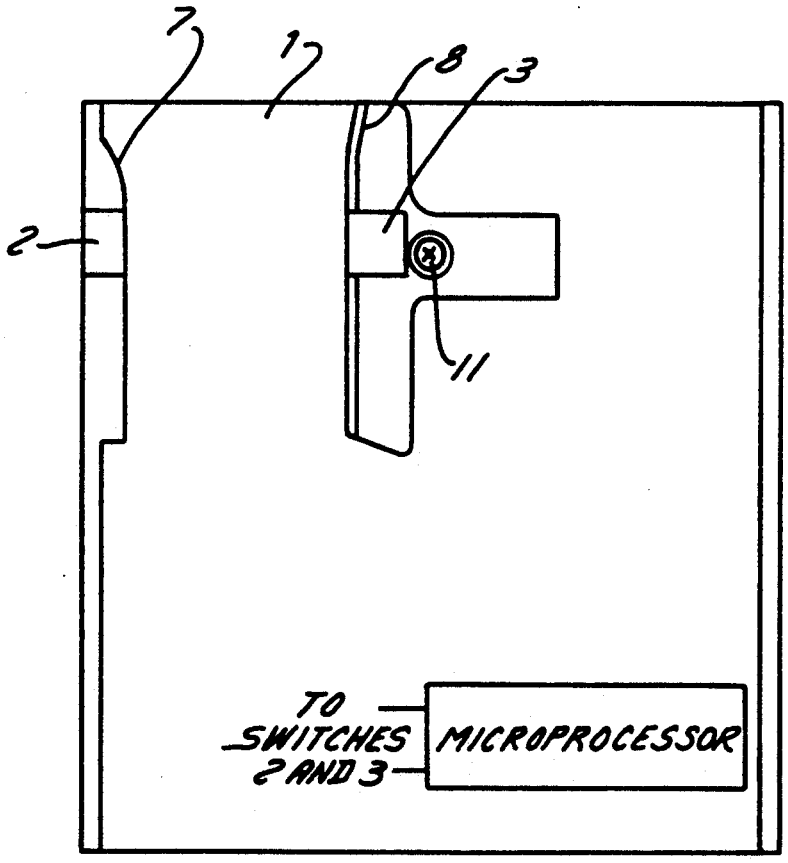
FIG. 2 is a view similar to FIG. 1 but showing an adjustment for one proximity switch.

Referring to FIG. 1 illustrating an embodiment of one way type coin discriminating apparatus according to the invention, the apparatus has a coin inlet (not shown) having a dimension which does not accept coins having diameter and thickness larger than those of the genuine coin. A coin inserted from the coin inlet drops in a vertical coin passage 1 which is defined vertical edge plates 7 and 8 which are parallelly spaced apart by a distance larger than the diameter of the genuine coin and vertical side plates (not shown) which are parallelly spaced apart by a distance corresponding to the thickness of the genuine coin.

In the vertical coin passage 1, a magnet type proximity switch 2 is fixedly secured to the edge plate 7 and a magnet type proximity switch 3 is adjustably secured to the opposed edge plate 8 so as to be adjusted the distance between the proximity switches 2 and 3 in the horizontal direction or coin diameter direction. The proximity switches 2 and 3 are opposedly arranged and spaced from each other by a distance corresponding to the diameter of the genuine coin by adjusting the position of the adjustable proximity switch 3 in the horizontal direction by means of an adjusting screw 11 or the like.

Figure 3:
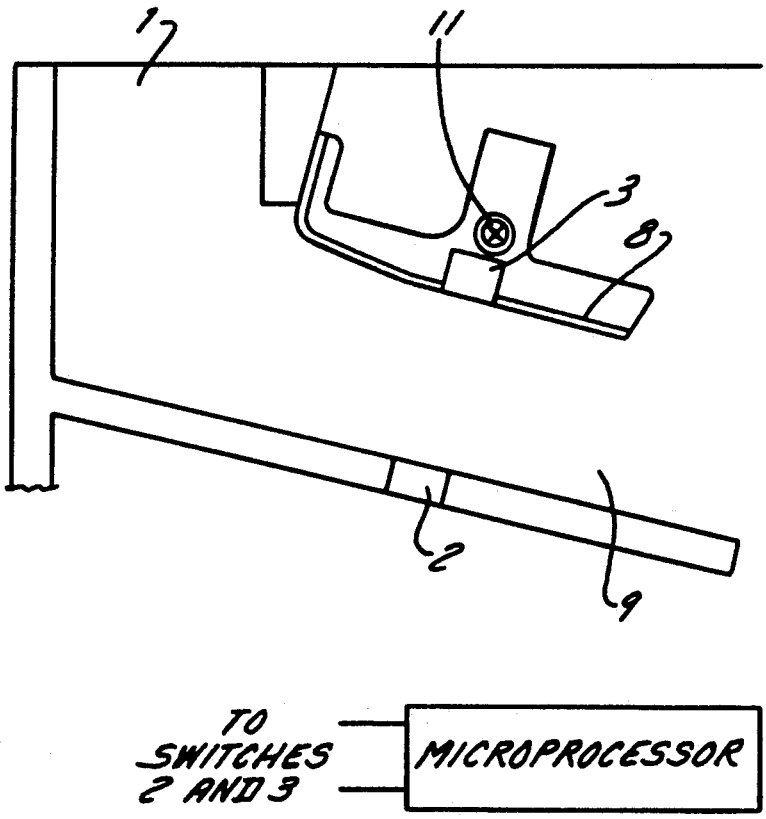
FIG. 3 is a schematic view of an inclined coin passage.

In an inclined coin passage 9 (FIG. 3) connected to the bottom of the vertical coin passage 1, a pair of material discriminating sensor coils 5 and 6 are opposedly arranged at the opposite sides of the inclined coin passage 9.

The proximity switches are connected to a discriminating microcomputer (not shown) such that a genine coin diameter signal is output when both the proximity switches 2 and 3 are simultaneously turned ON by a coin passing through the vertical coin passage 1 between the proximity switches 2 and 3.

Also, the material discriminating sensor coils 5, 6 are connected to the discriminating computer which is arranged such that a genuine coin signal is output therefrom when the genuine coin diameter signal is input and a variation of oscillating voltage input from an L. C. oscillating circuit connected to the receiving sensor coil 6 is the same as that of a stored reference variation of voltage of genuine coin.

It will be understood that the arrangement of coin diameter discriminating proximity switches according to the present invention is also applicable for the inclined coin passage 9 as well as the vertical coin passage 1.

What is claimed is:

1. An electronic coin discriminating apparatus comprising a coin passage for passing a coin to be discriminated, coin diameter detecting means for producing an output corresponding to the diameter of the coin passing through the coin passage, and genuine coin discriminating means arranged such that a genuine acceptable coin signal is output therefrom when a genuine coin diameter signal is input, said coin diameter detecting means including a pair of proximity switches opposedly arranged in a coin diameter direction of a coin passing through the coin passage and spaced from each other by a distance corresponding to the diameter of the genuine coin by adjusting the position of one of the proximity switches with respect to the other in the coin diameter direction.

2. Apparatus claimed in claim 1, wherein the coin passage is a vertical coin passage.

3. Apparatus claimed in claim 1, wherein the coin passage is an inclined coin passage.

4. Apparatus claimed in claim 1, wherein the position of at least one of the proximity switch is adjustable in the coin diameter direction so that the spacing of the proximity switches is adjustable to correspond to the diameter of a coin to be discriminated.

5. Apparatus claimed in claim 4, wherein the one proximity switch is adjustable by an adjusting screw.

6. Apparatus as claimed in claim 1, wherein the proximity switches are of the magnet type.

7. Apparatus as claimed in claim 1, wherein the proximity switches are spaced from each other by a distance equal to the diameter of the genuine coin.

8. Apparatus as claimed in claim 1, including material discriminating sensor coils.

* * * * *